US007824834B2

(12) United States Patent
Awamura et al.

(10) Patent No.: US 7,824,834 B2
(45) Date of Patent: Nov. 2, 2010

(54) TONER FOR DEVELOPING ELECTROSTATIC IMAGE, METHOD FOR PREPARING THE TONER, AND IMAGE FORMING METHOD AND APPARATUS USING THE TONER

(75) Inventors: Junichi Awamura, Numazu (JP); Akinori Saitoh, Numazu (JP); Masahide Yamada, Numazu (JP); Toyoshi Sawada, Hiratsuka (JP); Takuya Seshita, Hiratsuka (JP); Tomomi Suzuki, Numazu (JP)

(73) Assignee: Ricoh Company Limited, Tokyo (JP)

( * ) Notice: Subject to any disclaimer, the term of this patent is extended or adjusted under 35 U.S.C. 154(b) by 395 days.

(21) Appl. No.: 11/855,806

(22) Filed: Sep. 14, 2007

(65) Prior Publication Data

US 2008/0070148 A1 Mar. 20, 2008

(30) Foreign Application Priority Data

Sep. 15, 2006 (JP) ..... 2006-250343

(51) Int. Cl.
*G03G 9/00* (2006.01)

(52) U.S. Cl. ..... 430/111.4; 430/109.4; 430/137.17; 399/350

(58) Field of Classification Search ..... 430/111.4, 430/109.4, 137.17; 399/350
See application file for complete search history.

(56) References Cited

U.S. PATENT DOCUMENTS

| | | | |
|---|---|---|---|
| 5,403,690 | A | 4/1995 | Kuramoto et al. |
| 5,554,478 | A | 9/1996 | Kuramoto et al. |
| 5,840,456 | A | 11/1998 | Tomita et al. |
| 5,975,446 | A | 11/1999 | Yaguchi et al. |
| 6,074,794 | A | 6/2000 | Fushimi et al. |
| 6,303,258 | B1 | 10/2001 | Katoh et al. |
| 6,406,826 | B1 | 6/2002 | Suzuki et al. |
| 6,500,595 | B1 | 12/2002 | Mochizuki et al. |
| 6,566,026 | B2 | 5/2003 | Watanabe et al. |
| 6,653,037 | B2 | 11/2003 | Sawada et al. |
| 6,716,561 | B2 | 4/2004 | Shiraishi et al. |
| 6,757,507 | B2 | 6/2004 | Mochizuki et al. |
| 6,770,411 | B2 | 8/2004 | Masuda et al. |
| 6,818,369 | B2 | 11/2004 | Sugiura et al. |
| 6,821,698 | B2 | 11/2004 | Sawada et al. |
| 6,828,075 | B2 | 12/2004 | Suzuki et al. |
| 6,830,859 | B2 | 12/2004 | Shiraishi et al. |
| 6,852,459 | B2 | 2/2005 | Katoh et al. |
| 6,858,365 | B2 | 2/2005 | Sawada et al. |
| 6,861,191 | B2 | 3/2005 | Mochizuki et al. |
| 6,902,857 | B2 | 6/2005 | Yagi et al. |
| 6,902,858 | B2 | 6/2005 | Mochizuki et al. |
| 6,939,653 | B2 | 9/2005 | Suzuki et al. |
| 6,977,129 | B2 | 12/2005 | Saito et al. |
| 7,024,140 | B2 | 4/2006 | Masuda et al. |
| 7,049,037 | B2 | 5/2006 | Katoh et al. |
| 7,052,815 | B2 | 5/2006 | Sawada et al. |
| 7,060,407 | B2 | 6/2006 | Nagayama et al. |
| 7,083,890 | B2 | 8/2006 | Emoto et al. |
| 7,129,013 | B2 | 10/2006 | Higuchi et al. |
| 7,132,210 | B2 | 11/2006 | Suzuki et al. |
| 7,163,774 | B2 | 1/2007 | Shiraishi et al. |
| 7,169,522 | B2 | 1/2007 | Sugiura et al. |
| 7,209,699 | B2 | 4/2007 | Yamaguchi et al. |
| 7,217,485 | B2 | 5/2007 | Hasegawa et al. |
| 7,235,338 | B2 | 6/2007 | Takada et al. |
| 7,309,558 | B1 * | 12/2007 | Michel et al. ..... 430/137.1 |
| 7,459,255 | B2 * | 12/2008 | Tanaka et al. ..... 430/110.3 |
| 2001/0044059 | A1 | 11/2001 | Miyamoto et al. |
| 2002/0098436 | A1 | 7/2002 | Miyamoto et al. |
| 2003/0152857 | A1 | 8/2003 | Sugiura et al. |
| 2003/0180643 | A1 | 9/2003 | Suzuki et al. |
| 2004/0076901 | A1 | 4/2004 | Miyamoto et al. |
| 2004/0229147 | A1 | 11/2004 | Higuchi et al. |
| 2004/0265721 | A1 | 12/2004 | Matsuoka et al. |

(Continued)

FOREIGN PATENT DOCUMENTS

| | | |
|---|---|---|
| JP | 9-15903 | 1/1997 |

(Continued)

OTHER PUBLICATIONS

U.S. Appl. No. 12/026,937, filed Feb. 6, 2008, Seshita, et al.

(Continued)

*Primary Examiner*—John L Goodrow
(74) *Attorney, Agent, or Firm*—Oblon, Spivak, McClelland, Maier & Neustadt, L.L.P.

(57) ABSTRACT

A toner including a binder resin; a colorant; a release agent; and a modified layered inorganic material in which at least part of interlayer ions is modified with an organic ion, wherein the toner has a volume average particle diameter (Dv) of 3 to 7 μm and a ratio (Dv/Dn) of the volume average particle diameter (Dv) to a number average particle diameter (Dn) of the toner of 1.00 to 1.30, and wherein the release agent is included in the toner in an amount (A) of 1 to 10% by weight, and the ratio (B/A) of the amount (A) to the amount (B) of the release agent included in a classified toner in units of percent by weight is 0.7 to 1.3, wherein the classified toner satisfies the relationship $(Dv'/Dn'-1)/(Dv/Dn-1) \leqq 3/4$ wherein Dv' and Dn' respectively represent the volume and number average particle diameters of the classified toner.

28 Claims, 2 Drawing Sheets

U.S. PATENT DOCUMENTS

| | | | |
|---|---|---|---|
| 2005/0031980 | A1 | 2/2005 | Inoue et al. |
| 2005/0112488 | A1 | 5/2005 | Yamada et al. |
| 2005/0164112 | A1 | 7/2005 | Ohki et al. |
| 2005/0180786 | A1 | 8/2005 | Yamada et al. |
| 2005/0186498 | A1 | 8/2005 | Honda et al. |
| 2005/0214670 | A1 | 9/2005 | Matsumoto et al. |
| 2005/0250037 | A1 | 11/2005 | Sawada et al. |
| 2006/0024097 | A1 | 2/2006 | Yamada et al. |
| 2006/0046174 | A1 | 3/2006 | Ohki et al. |
| 2006/0057488 | A1 | 3/2006 | Inoue et al. |
| 2006/0063089 | A1 | 3/2006 | Tanaka et al. |
| 2006/0068312 | A1 | 3/2006 | Yamashita et al. |
| 2006/0093946 | A1 | 5/2006 | Miyamoto et al. |
| 2006/0099529 | A1 | 5/2006 | Tanaka et al. |
| 2006/0127152 | A1 | 6/2006 | Nagayama et al. |
| 2006/0133872 | A1 | 6/2006 | Sugiura et al. |
| 2006/0160011 | A1 | 7/2006 | Inoue et al. |
| 2006/0204883 | A1 | 9/2006 | Nakayama et al. |
| 2006/0210334 | A1 | 9/2006 | Tokumasu et al. |
| 2006/0210903 | A1 | 9/2006 | Ohki et al. |
| 2006/0222987 | A1 | 10/2006 | Suzuki et al. |
| 2006/0251979 | A1 | 11/2006 | Watanabe et al. |
| 2006/0285897 | A1 | 12/2006 | Sugiura et al. |
| 2007/0054210 | A1 | 3/2007 | Ohki et al. |
| 2007/0059626 | A1 | 3/2007 | Inoue et al. |
| 2007/0141506 | A1 | 6/2007 | Inoue et al. |

FOREIGN PATENT DOCUMENTS

| | | | |
|---|---|---|---|
| JP | 11-133665 | | 5/1999 |
| JP | 2003-202708 | | 7/2003 |
| JP | 2004-46095 | | 2/2004 |
| WO | WO 01/40878 | A1 | 6/2001 |
| WO | WO 2004/019137 | A1 | 3/2004 |
| WO | WO 2004/019138 | A1 | 3/2004 |

OTHER PUBLICATIONS

U.S. Appl. No. 12/042,041, filed Mar. 4, 2008, Yamada, et al.
U.S. Appl. No. 12/046,941, filed Mar. 12, 2008, Awamura, et al.
U.S. Appl. No. 11/687,372, filed Mar. 16, 2007, Masahide Yamada, et al.
U.S. Appl. No. 11/687,404, filed Mar. 16, 2007, Takuya Seshita, et al.
U.S. Appl. No. 11/687,060, filed Mar. 16, 2007, Shigeru Emoto, et al.
U.S. Appl. No. 11/685,969, filed Mar. 14, 2007, Osamu Uchinokura, et al.
U.S. Appl. No. 11/687,075, filed Mar. 16, 2007, Masahide Yamada, et al.
U.S. Appl. No. 12/203,278, filed Sep. 3, 2008, Yamada, et al.
U.S. Appl. No. 12/209,583, filed Sep. 12, 2008, Seshita, et al.
U.S. Appl. No. 12/260,493, filed Oct. 29, 2008, Sawada, et al.

* cited by examiner

TONER FOR DEVELOPING ELECTROSTATIC IMAGE, METHOD FOR PREPARING THE TONER, AND IMAGE FORMING METHOD AND APPARATUS USING THE TONER

BACKGROUND OF THE INVENTION

1. Field of the Invention

The present invention relates to a toner for developing an electrostatic image. In addition, the present invention also relates to a method for preparing the toner, and an image forming method and an image forming apparatus using the toner.

2. Discussion of the Background

Recently, a need exists for an electrophotographic image forming apparatus which can produce high quality images. In attempting to fulfill the need, various electrophotographic image forming apparatuses and toners have been proposed and developed. In order to produce high quality images by a toner, the toner preferably has a sharp particle diameter distribution. Specifically, when a toner has a sharp particle diameter distribution, the toner particles can exhibit almost the same behavior in an image developing process, and thereby images with improved fine dot reproducibility can be produced.

However, conventional toners having a relatively small particle diameter and a relatively sharp particle diameter distribution tend to cause a cleaning problem in that toner particles remaining on a surface of an image bearing member (such as photoreceptors and intermediate transfer belts) cannot be well removed with a cleaning blade, resulting in formation of images with background development. In attempting to solve the cleaning problem by toner, various proposals have been made. For example, a toner whose particle form is changed from the spherical form to irregular forms (this particle form change is hereinafter referred to as deformation) is proposed. By deforming a toner, the fluidity of the toner deteriorates and thereby toner particles remaining on an image bearing member can be blocked with a cleaning blade. Therefore, the residual toner particles can be well removed with the blade. However, when deformation of a toner is excessively performed, the behavior of the toner particles thereof becomes unstable, and thereby the fine dot reproducibility of the toner is deteriorated.

In addition, by deforming a toner, the fixability of the toner tends to deteriorate although the cleanability thereof is improved. Specifically, a toner layer constituting a toner image has low density (i.e., there are many voids in the toner layer), and therefore the toner layer has low heat conductivity, resulting in deterioration of the low temperature fixability of the toner. This phenomenon is remarkable when the fixing pressure is relatively low.

Published unexamined Japanese patent application No. (hereinafter referred to as JP-A) 11-133665 discloses a toner constituted of a polyester resin and having a Wadell working sphericity of from 0.90 to 1.00. This toner has substantially spherical form, and therefore the toner has poor cleanability.

When toner particles are prepared by polymerization methods, suspension polymerization methods, emulsion polymerization methods and solution suspension methods can be typically used. Among these methods, the emulsion polymerization methods and solution suspension methods can easily produce deformed toner particles. However, emulsion polymerization methods have a drawback in that residual monomers (such as styrene monomer), emulsifiers and dispersants cannot be perfectly removed from the reaction product. Such toner pollutes the environmental.

When toner particles having projected portions and recessed portions are mixed with an external additive (i.e., fluidizer) such as silica, particles of the external additive adhered to projected portions tend to move to recessed portions after long repeated used because adhesiveness of the external additive to recessed portions is relatively weak compared to adhesiveness thereof to recessed portions. In this case, the toner contaminates the image bearing members such as photoreceptors and fixing members such as fixing rollers, resulting in deterioration of image qualities and occurrence of jamming in a fixing device.

The solution suspension methods, in which a toner composition liquid, in which toner constituents are dissolved or dispersed in an organic solvent, is granulized in an aqueous medium to prepare toner particles, have an advantage in that polyester resins, which have relatively good low temperature fixability, can be used as binder resins. In the solution suspension methods, a high molecular weight component is included in a toner composition liquid and therefore the toner composition liquid tends to have a high viscosity. Therefore, the solution suspension methods tend to have a production problem in that toner particles cannot be easily prepared. JP-A 09-15903 discloses a toner, which has spherical form and whose surface is roughened to have asperities, in attempting to impart good cleanability to the toner. However, the asperities of the surface of the toner do not have regularity, and therefore the toner has poor charge stability. In addition, controlling of molecular weight of the binder resin thereof is not performed, and therefore a good combination of durability and releasability cannot be imparted to the toner.

Toner can also be prepared by pulverization methods. Pulverization methods typically includes kneading toner constituents such as binder resins, colorants and additives (such as charge controlling agents) upon application of heat thereto, pulverizing the kneaded mixture, and then classifying the pulverized mixture to prepare toner particles. The pulverization methods have the following drawbacks.

(1) toner having a small average particle diameter cannot be provided (i.e., the particle diameter has a certain lower limit);

(2) it is impossible to properly position toner constituents in toner particles (for example, to position a charge controlling agent in a surface portion); and (3) when the added amount of a charge controlling agent is increased, a filming problem in that a film of the charge controlling agent is formed on the surface of carrier particles used for the developer and/or image bearing members, resulting in deterioration of image qualities and a fixing problem in that toner images cannot be firmly fixed to receiving materials particularly at a low fixing temperature are caused.

PCT patent application publications Nos. 2003-515795 (WO01/040878), 2006-500605 (WO2004/019138) and 2006-503313 (WO2004/019137), and JP-A 2003-202708 have disclosed to use layered inorganic materials, in which interlayer ions (such as metal cations) are modified with an organic cation, as charge controlling agents of toners. However, the toners including such layered inorganic materials also have the drawbacks mentioned above.

Because of these reasons, a need exists for a toner which has good chargeability and good releasability so as to be used for oil-less fixing devices and which can produce high quality and high definition images without causing the cleaning problem, filming problem and fixing problem.

SUMMARY OF THE INVENTION

As an aspect of the present invention, a toner is provided which includes a binder resin, a colorant, a release agent and a modified layered inorganic material in which at least part of interlayer ions is modified with an organic ion. The toner has a volume average particle diameter (Dv) of from 3 to 7 μm and a ratio (Dv/Dn) of the volume average particle diameter (Dv) to a number average particle diameter (Dn) of the toner of from 1.00 to 1.30. In addition, the toner satisfies the following relationships:

$$1\% \leqq A \leqq 10\%, \text{ and}$$

$$0.7 \leqq B/A \leqq 1.3,$$

wherein A represents the amount of the release agent included in the toner in units of percent by weight, and B represents the amount of the release agent included in particles of the toner in units of percent by weight, wherein the particles of the toner are obtained by classifying the toner to an extent such that the following relationship is satisfied:

$$(Dv'/Dn'-1)/(Dv/Dn-1) \leqq 3/4,$$

wherein Dv' and Dn' respectively represent a volume average particle diameter and a number average particle diameter of the particles of the toner obtained by classification.

As another aspect of the present invention, a method for preparing a toner is provided which includes:

dissolving or dispersing at least one of a binder resin and a binder resin precursor, a colorant, a release agent and a modified layered inorganic material in an organic solvent to prepare an oil phase liquid;

dispersing the oil phase liquid in an aqueous medium to prepare an emulsion; and removing the organic solvent from the emulsion to prepare toner particles, wherein the toner has the properties mentioned above and satisfies the relationships mentioned above.

As yet another aspect of the present invention, an image forming method is provided which includes:

developing an electrostatic latent image on an image bearing member with a developer including the toner mentioned above to prepare a toner image on the image bearing member;

transferring the toner image onto a receiving material optionally via an intermediate transfer medium; and cleaning the surface of the image bearing member with a blade to remove particles of the toner remaining thereon.

As a further aspect of the present invention, an image forming apparatus is provided which includes:

an image bearing member configured to bear an electrostatic latent image thereon; and a developing device configured to develop the electrostatic latent image with a developer including the toner mentioned above to form a toner image on the image bearing member;

a transfer device configured to transfer the toner image onto a receiving material optionally via an intermediate transfer medium; and a cleaning device configured to clean the surface of the image bearing member with a blade to remove particles of the toner remaining thereon.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
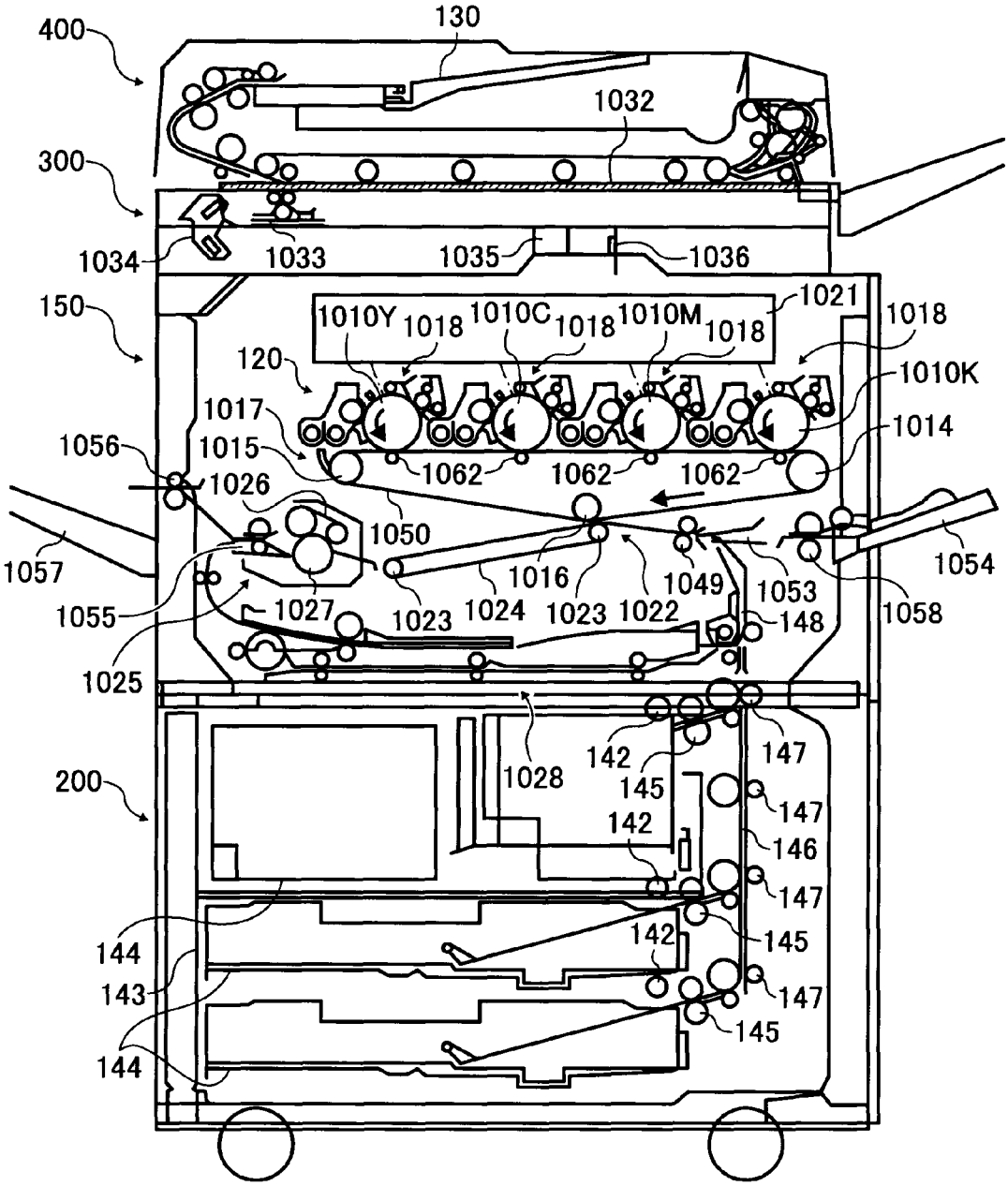
FIG. 1 is a schematic view illustrating an example of the image forming apparatus of the present invention.

The toner of the present invention includes at least a binder resin, a colorant, a release agent and a modified layered inorganic material in which at least part of interlayer ions is modified with an organic ion. The toner is preferably prepared by emulsifying an oil phase liquid, which is prepared by dissolving or dispersing the binder resin and/or a binder resin precursor, the colorant, the release agent and the modified layered inorganic material in an organic solvent, in an aqueous medium (i.e., an aqueous phase liquid) to prepare an emulsion; optionally subjecting the emulsion to a reaction when a binder resin precursor is included; and removing the organic solvent from the emulsion to prepare toner particles.

Modified layered inorganic materials are hydrophobic under normal conditions. The affinity of such modified layered inorganic materials for an aqueous phase liquid or an oil phase liquid changes depending on the properties of interlayer ions thereof and the amount of interlayer ions therein. In the present invention, layered inorganic materials modified with an organic ion are used. By using a modified layered inorganic material which is modified with an organic ion so as to have a proper affinity for the aqueous phase liquid and oil phase liquid used, a toner in which the modified layered inorganic material is mainly included in a surface portion of the toner particles can be provided. Namely, in the emulsion mentioned above, the modified layered inorganic material moves toward the interface between the oil phase liquid and the aqueous phase liquid, and thereby a toner in which the modified layered inorganic material is mainly included in a surface portion of toner particles can be provided. In this case, the modified layered inorganic material can impart good charging property to the toner particles because a charge controlling agent present in a surface portion can well exhibit a charging function.

When the degree of modification using an organic ion is low, the resultant modified layered inorganic material has poor hydrophobicity. In addition, the layered inorganic material hardly causes layer-peeling in a dispersing process, and thereby the layered inorganic material cannot be well dispersed in the oil phase liquid. In this case, a toner in which the layered inorganic material is mainly included in a surface portion of the toner particles cannot be provided.

By modifying a layered inorganic material while using a relatively large amount of organic ion or changing the inorganic ion or by subjecting a layered inorganic material to a hydrophobizing treatment such that the resultant modified layered inorganic material has a large hydrophobicity, the modified layered inorganic material tends to be evenly dispersed in toner particles or mainly dispersed in a central portion of toner particles. In this case, a good charging property cannot be imparted to the toner.

As a result of the present inventors' experiments, it is found that when the added amount of a modified layered inorganic material is increased, the content of the release agent in a surface portion of the toner decreases. In addition, it is found that when a toner is subjected to a classification treatment, the content of the release agent in fine toner particles is less than that in coarse toner particles. In addition, it is also found that toner having a property such that the content of a release agent in fine toner particles is largely different from that in coarse toner particles causes a fixing problem in that a toner image is not well released from a fixing member due to fine toner particles including a release agent in a small amount and a spent toner problem in that a film of the toner is formed on the surfaces of carrier particles and image forming members, and thereby the charging ability of the carrier particles and the properties of the image forming members are deteriorated, resulting in formation of images with poor image qualities. Further, it is found that a toner does not cause the above-mentioned fixing problem and spent toner problem when the toners satisfy the following relationships:

$$1\% \leqq A \leqq 10\%, \text{ and}$$

$$0.7 \leqq B/A \leqq 1.3,$$

wherein A represents the amount of the release agent included in the toner in units of percent by weight, and B represents the amount of the release agent included in particles of the toner in units of percent by weight, wherein the particles of the toner are obtained by classifying the toner to an extent such that the following relationship is satisfied:

$$(Dv'/Dn'-1)/(Dv/Dn-1) \leqq 3/4,$$

wherein Dv' and Dn' respectively represent the volume average particle diameter and number average particle diameter of the particles of the toner.

In this regard, the particle diameter of the toner particles obtained by classification is not particularly limited.

When the ratio B/A is 1.0, the content of the release agent included in toner particles is substantially constant even when the particle diameter of the toner particles is different. In contrast, when the ratio B/A is less than 0.7 or greater than 1.3, the content of the release agent in fine toner particles is less than that in coarse toner particles, and therefore the toner causes the fixing problem and spent toner problem. Therefore, it is preferable that the ratio B/A is controlled so as to fall in a range of from 0.7 to 1.3.

When preparing toner particles using the emulsification method mentioned above, the modified layered inorganic material is mainly present in a surface portion of the toner particles, and thereby the function of the modified layered inorganic material can be fully exhibited even when the added amount of the modified layered inorganic material is small. Since the added amount is small, the toner hardly causes the fixing problem. In addition, by using the emulsification method mentioned above, toner particles having a small average particle diameter can be provided, and the modified layered inorganic material can be well dispersed in the toner particles while located in a surface portion.

The toner composition liquid (i.e., oil phase liquid) are prepared by dissolving or dispersing toner constituents (such as binder resins, binder resin precursors, colorants, release agents and modified layered inorganic materials in a solvent preferably including an organic solvent. The organic solvent used is preferably removed after or during the toner particle preparation process.

Suitable organic solvents for use in the oil phase liquid include volatile solvents having a boiling point lower than 150° C. (preferably lower than 100° C.) so as to be easily removed from the emulsion. Specific examples of such volatile solvents include toluene, xylene, benzene, carbon tetrachloride, methylenechloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these organic solvents, toluene, xylene, benzene, methylene chloride, 1,2-dichloroethane, chloroform and carbon tetrachloride are preferably used. Although the content of the organic solvent in the oil phase liquid is determined depending on the targeted properties of the resultant toner particles, the weight ratio of the organic solvent to the total weight of the toner constituents is generally from 40/100 to 300/100, preferably from 6/100 to 140/100 and more preferably from 80/100 to 120/100.

The oil phase liquid can include materials other than binder resins, colorants, release agents and modified layered inorganic materials. For examples, monomers, polymers, and combinations of a compound having active hydrogen and a polymer reactive with such a compound can be used for the binder resin. In this case, the materials are subjected to one or more of polymerization reactions, molecular weight growth reactions and crosslinking reactions in the emulsion to prepare a binder resin of the toner particles.

Layered inorganic materials are defined as inorganic minerals in which layers having a thickness of few nanometers are overlaid. Modifying the materials with organic ions means that one or more organic ions are incorporated as interlayer ions. This is called intercalation. Intercalation is explained in detail in PCT application publications Nos. WO01/040878, WO2004/019138 and WO2004-019137. Specific examples of the layered inorganic materials include smectite family (e.g., montmorillonite and saponite), kaolin family (e.g., kaolinite), magadiite, and kanemite. Because of having a layered structure, the layered inorganic materials have good hydrophilicity. When an unmodified layered inorganic material is included in a toner composition liquid and the toner composition liquid is dispersed in an aqueous medium to prepare toner particles, the material is migrated into the aqueous medium, and thereby deformation of toner particles cannot be performed (i.e., spherical toner particles are formed and toner particles having forms other than spherical form (i.e., irregular forms) cannot be prepared). In contrast, when a modified layered inorganic material, which has a less hydrophilicity (i.e., greater hydrophobicity) than unmodified layered inorganic materials, is used, the material forms fine toner particles with irregular forms in the granulation process (i.e., the toner particle preparation process). In addition, the material tends to be present in a surface portion of the resultant toner particles, and thereby a good charge controlling function of the modified layered inorganic material can be imparted to the toner. The added amount of a modified layered inorganic material in the toner composition liquid is preferably from 0.05 to 5%, and more preferably from 0.05 to 2%, by weight based on the total weight of the solid components included in the toner composition liquid.

The modified layered inorganic material for use in the toner of the present invention is preferably a layered inorganic material having a smectite crystal form and modified by an organic cation. In addition, it is preferable to replace a divalent metal ion of the layered inorganic material with a trivalent metal ion to incorporate a metal anion in the layered inorganic material. In this regard, the metal-anion-incorporated layered inorganic material has high hydrophilicity, and therefore it is preferable to replace at least part of the metal anions with an organic anion.

Suitable organic compounds for use in incorporating organic ions in layered inorganic materials include quaternary alkyl ammonium salts, phosphonium salts, imidazolium salts, etc. Among these compounds, quaternary alkyl ammonium salts are preferable. Specific examples of the quaternary alkyl ammonium salts include trimethylstearyl ammonium, dimethylstearylbenzyl ammonium, dimethyloctadecyl ammonium, oleylbis (2-hydroxyethyl) methyl ammonium, etc.

Specific examples of other organic compounds for use in incorporating organic ions include sulfates, sulphonates, carboxylates, and phosphates having a group (or a structure) such as linear, branched or cyclic alkyl groups (C1-C44), alkenyl groups (C1-C22), alkoxyl groups (C8-C32), hydroxyalkyl groups (C2-C22), ethylene oxide structures, and propylene oxide structures. Among these compounds, carboxylic acids having an ethylene oxide structure are preferably used.

When at least part of interlayer ions of a layered inorganic material is modified with one or more organic ions, the modified layered inorganic material has proper hydrophobicity. By including such a modified layered inorganic material in a toner composition liquid, the toner composition liquid has a non-Newtonian viscosity, and thereby deformed toner particles can be prepared. As mentioned above, the added amount of a modified layered inorganic material in the toner composition liquid is preferably from 0.05 to 5%, and more preferably from 0.05 to 2%, by weight based on the total weight of the solid components included in the toner composition liquid. Modified versions of layered inorganic materials such as montmorillonite, bentonite, hectolite, hectorite, attapulgite, sepiolite, and mixtures of these materials are preferably used. Among these materials, modified montmorillonite and bentonite are preferably used because the modified versions of these materials can easily adjust the viscosity of a toner composition liquid even in a small added amount without deteriorating the properties of the resultant toner.

Specific examples of the marketed products of organic-cation-modified layered inorganic materials include quaternium 18 bentonite such as BENTONE 3, BENTONE 38, BENTONE 38V, (from Elementis Specialties), THIXOGEL VP (from United Catalyst), CLAYTON 34, CLAYTON 40, and CLAYTON XL (from Southern Clay Products); stearalkonium bentonite such as BENTONE 27 (from Elementis Specialties), THIXOGEL LG (from United Catalyst), CLAYTON AF and CLAYTON APA (from Southern Clay Products); quaternium 18/benzalkonium bentonite such as CLAYTON HT and CLAYTON PS (from Southern Clay Products), etc. Among these materials, CLAYTON AF and CLAYTON APA are preferably used.

Specific examples of the marketed products of organic-anion-modified layered inorganic materials include materials which are prepared by modifying DHT-4A (from Kyowa Chemical Industry Co., Ltd.) with a material having the following formula (1) (such as HITENOL 330T from Dai-ichi Kogyo Seiyaku Co., Ltd.).

$$R_1(OR_2)_nOSO_3M \quad (1)$$

wherein $R_1$ represents an alkyl group having 13 carbon atoms; $R_2$ represents an alkylene group having 2 to 6 carbon atoms; n is an integer of from 2 to 10, and M represents a monovalent metal element.

Thus, by using a modified layered inorganic material for the oil phase liquid, the material tends to be present near the interface between the oil phase liquid and the aqueous phase liquid in the emulsion, and thereby the material tends to be present in a surface portion of the resultant toner particles. Therefore, good charging property can be imparted to the resultant toner.

The toner of the present invention preferably has a ratio (Dv/Dn) of the volume average particle diameter (Dv) to the number average particle diameter (Dn) of from 1.00 to 1.30, and more preferably from 1.00 to 1.20. In this case, the toner can produce high quality and high definition images. In addition, variation of the particle diameter distribution of the toner is little and the toner can maintain good developability even when the toner is agitated for a long period of time in a developing device while a fresh toner is supplied thereto. When the ratio (Dv/Dn) is too large, variation of the particle diameter distribution of the toner becomes large, and thereby the behavior of the toner varies, resulting in deterioration of fine dot reproducibility.

The toner of the present invention preferably has a volume average particle diameter (Dv) of from 3.0 to 7.0 μm.

In general, using a toner having a small average particle diameter is advantageous to produce high definition and high quality images. However, such a toner is inferior in transferability and cleanability. When a toner having a volume average particle diameter smaller than the above-mentioned range is used for a two component developer, the toner tends to cause a problem in that the developer is fixedly adhered to a carrier after long term agitation, resulting in deterioration of the charging ability of the carrier. When such a small toner is used as a one component developer, problems in that the toner forms a film on a developing roller, and the toner is fixedly adhered to members such as blades configured to form a thin toner layer on a developing roller tend to be caused. In addition, these phenomena are largely influenced by the content of fine toner particles. Specifically, when toner particles having a particle diameter of not greater than 2 μm are included in an amount of greater than 20% by number, the toner adhesion problem is seriously caused and in addition the charge stability of the toner seriously deteriorates. Therefore, the content of toner particles having a particle diameter of not greater than 2 μm in the toner is preferably not greater than 20% by number.

In contrast, when the volume average particle diameter of the toner is larger than the above-mentioned range, it is difficult to produce high definition and high quality images and in addition a problem in that the particle diameter distribution of the toner in a developer largely changes when the toner is used while replenishing a fresh toner to the developer, resulting in variation of image qualities tends to occur. The same is true for the case where the ratio (Dv/Dn) is too large.

As mentioned above, toners having a small particle diameter and a small Dv/Dn ratio tend to cause the cleaning problem in that toner particles remaining on an image bearing member cannot be easily removed with a cleaning blade. Therefore, the toner of the present invention preferably includes toner particles with a circularity of not greater than 0.950 in an amount of from 20 to 80% by number. The reason therefor will be explained below.

At first, the relationship between the shape of toner and transferability of the toner will be explained. In full color copiers, the amount of toner particles present on an image bearing member is larger than that in black and white copiers. Therefore, it is difficult to improve the transfer efficiency by using conventional toners having irregular forms. Further, when a conventional toner having irregular forms is used, the toner tends to be fixedly adhered to the surfaces of the photoreceptor and intermediate transfer medium used (or a toner film is formed on the surfaces) due to friction therebetween, resulting in deterioration of transferability of toner images. Particularly, in full color image forming apparatus, four color toner images cannot be evenly transferred to an intermediate transfer medium, thereby producing full color images with poor evenness and color balance. Namely, high quality full color images cannot be produced.

Toner including toner particles with a circularity of not greater than 0.950 in an amount of from 20 to 80% by number has a good combination of blade cleanability and transfer efficiency. The blade cleanability is also influenced by other factors such as choice of material for the cleaning blade and setting conditions of the cleaning blade (such as the angle of the cleaning blade against the image bearing member), and the transfer efficiency is also influenced by transfer conditions such as voltage of the transfer bias. When the toner of the present invention includes toner particles with a circularity of not greater than 0.950 in an amount of from 20 to 80% by number, good combination of blade cleanability and transfer efficiency can be maintained by optimizing the above-mentioned factors.

However, when the content of toner particles with a circularity of not greater than 0.950 is too low, the blade cleanability deteriorates. In contrast, when the content of such toner particles is too high, the transfer efficiency deteriorates. The reason therefor is as follows. In this case, almost all the toner particles have irregular forms, the toner particles are not smoothly transferred (from the surface of an image bearing member to the surface of an intermediate transfer medium or a receiving material, from the surface of an intermediate transfer medium to a receiving material, etc.) and in addition the behavior of the toner particles varies. Therefore, it is difficult to evenly transfer toner images with high efficiency. In addition, the toner has unstable charging property and the toner particles of the toner tend to be easily cracked, resulting in formation of fine toner particles when the toner is agitated together with a carrier in a developing device. Thus, the toner has poor durability. Therefore, the toner of the present invention preferably includes toner particles with a circularity of not greater than 0.950 in an amount of from 20 to 80% by number.

Next, the methods for measuring the above-mentioned toner properties will be explained.

Content of Toner Particles With a Circularity of Not Greater Than 0.950 and Average Circularity of Toner These properties are measured with an instrument FPIA-2000 from Sysmex Corp.:

(1) at first 100 to 150 ml of water from which solid foreign materials have been removed, 0.1 to 0.5 ml of a surfactant (alkylbenzenesulfonate) and 0.1 to 0.5 g of a sample (i.e., toner) are mixed to prepare a dispersion;
(2) the dispersion is further subjected to a supersonic dispersion treatment for 1 to 3 minutes using a supersonic dispersion machine to prepare a dispersion including particles at a concentration of from 3,000 to 10,000 pieces/μl;
(3) the dispersion is passed through a detection area formed on a plate in the instrument; and
(4) the particles are optically detected by a CCD camera and then the shapes thereof are analyzed with an image analyzer.

Particle Diameter and Particle Diameter Distribution of Toner

The particle diameter and particle diameter distribution of a toner are measured with a method using an instrument such as COULTER COUNTER TA-II and COULTER MULTISIZER II from Beckman Coulter Inc. In the present application, a system including COULTER COUNTER TA-II, an interface capable of outputting particle diameter distribution on number and volume basis (from Nikka Giken), and a personal computer PC9801 (from NEC) is used to determine the particle diameter and particle diameter distribution. Specifically, the procedure is as follows:

(1) a surfactant serving as a dispersant (preferably 0.1 to 5 ml of a 1% aqueous solution of an alkylbenzenesulfonic acid salt), is added to an electrolyte such as 1% aqueous solution of first class NaCl or ISOTON-II manufactured by Beckman Coulter Inc.;
(2) 2 to20 mg of a sample to be measured is added into the mixture;
(3) the mixture is subjected to an ultrasonic dispersion treatment for about 1 to 3 minutes; and
(4) the volume-basis particle diameter distribution and number-basis particle diameter distribution of the sample are measured using the instrument and an aperture of 100 μm.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted. The volume average particle diameter (Dv) and number average particle diameter (Dn) are determined from the volume-basis particle diameter distribution and the number-basis particle diameter distribution. In addition, the ratio (Dv/Dn) can be determined by calculation.

The toner of the present invention is preferably prepared by a method including dissolving or dispersing toner constituents including at least a binder resin component including a binder resin precursor (such as polyester resins reactive with a compound having active hydrogen), a colorant, a release agent and a modified layered inorganic material in an organic solvent to prepare a toner composition liquid (i.e., an oil phase liquid), reacting the toner composition liquid (the binder component) with a crosslinking agent and/or a molecular weight growing agent in an aqueous medium including a dispersant, and then removing the organic solvent from the reaction product to prepare toner particles.

Suitable materials for use as the binder resin precursor include reactive modified polyester resins (RMPE) which are modified with a group reactive with active hydrogen. For example, polyester prepolymers (A) having an isocyanate group can be preferably used as reactive modified polyester resins. Polyester prepolymers having an isocyanate group can be prepared by reacting a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl groups and phenolic hydroxyl groups), amino groups, carboxyl groups, mercapto groups, etc. Among these groups, the alcoholic hydroxyl groups are preferable.

Suitable materials for use as the crosslinking agent for crosslinking the reactive modified polyester resins include amines. Suitable materials for use as the molecular chain growing agent for the reactive modified polyester resins include diisocyanate compounds (such as diphenyl methane diisocyanate). Amines mentioned later in detail serve as a crosslinking agent and a molecular chain growing agent of modified polyester resins reactive with active hydrogen.

Modified polyester resins such as urea-modified polyester resins, which can be prepared by reacting a polyester prepolymer (A) having an isocyanate group with an amine (B), can be preferably used for dry toners, and particularly, toners for use in image forming apparatus including an oil-less fixing device. This is because the molecular weight of the polyester resins can be easily controlled, and good low temperature fixability and good releasability can be imparted to the resultant toner. In particular, modified polyester resins whose end portion is urea-modified have the same fluidity and transparency in the fixable temperature range as those of the original polyester resins thereof (i.e., unmodified polyester resins) while having weak adhesiveness to heating members (such as heat rollers) of a fixing device.

Suitable polyester prepolymers for use in preparing toner particles of the toner of the present invention include polyester prepolymers which can prepared by incorporating a functional group (such as isocyanate groups) reactive with active hydrogen in a polyester having a group (such as hydroxyl groups) having active hydrogen. Modified polyester resins (MPE) (such as urea-modified polyester resins) can be prepared from such polyester prepolymers. When preparing toner particles of the toner of the present invention, it is preferable to use urea-modified polyester resins which can be prepared by reacting such a polyester prepolymer (A) with an amine (B) serving as a crosslinking agent and/or a molecular chain growing agent. The method for preparing a polyester prepolymer (A) having an isocyanate group is mentioned above.

Suitable polyols (PO) for use in preparing polyester prepolymers (A) include diols (DIO), polyols (TO) having three or more hydroxyl groups, and mixtures of DIO and TO. Preferably, diols (DIO) alone or mixtures of a diol (DIO) with a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acid (PC)

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha$, $\alpha$, $\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain growth inhibitor. Specific examples of the molecular chain growth inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The toner of the present invention preferably includes a urea-modified polyester resin (UMPE) as a binder resin. In this regard, the urea-modified polyester resin can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters such as UMPE can be prepared, for example, by a method such as one-shot methods or prepolymer methods. The weight average molecular weight of the modified polyesters is generally not less than 10,000, preferably from 20,000 to 10,000,000 and more preferably from 30,000 to 1,000,000. When the weight average molecular weight is too low, the hot offset resistance of the resultant toner deteriorates.

The number average molecular weight of the modified polyester resin is not particularly limited if an unmodified polyester resin is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner used for full color image forming apparatus, the resultant toner has low glossiness.

It is preferable for the toner of the present invention to include a combination of a modified polyester resin (such as UMPE) with an unmodified polyester resin as the binder resin of the toner. By using such a combination, the low temperature fixability of the toner can be improved and in addition the toner can produce color images having a high glossiness.

Suitable materials for use as the unmodified polyester resin (PE) include polycondensation products of a polyol (PO) with a polycarboxylic acid (PC). Specific examples of the polyol (PO) and polycarboxylic acid (PC) are mentioned above for use in the modified polyester resin. In addition, specific examples of the suitable polyol and polycarboxylic acid are also mentioned above. The weight average molecular weight (Mw) of the unmodified polyester resin (PE) is from 1,000 to 300,000, and preferably from 14,000 to 200,000. The number average molecular weight (Mn) thereof is from 1,000 to 10,000 and preferably from 1,500 to 6,000.

In addition, polyester resins including a bond (such as urethane bond) other than a urea bond are considered as the unmodified polyester resin (PE) in the present application.

When a combination of a modified polyester resin with an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/PE) of a modified polyester resin (MPE) to an unmodified polyester resin (PE) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to impart a good combination of high temperature preservability and low temperature fixability to the toner.

The unmodified polyester resin (PE) preferably has a glass transition temperature of from 35 to 65° C. In addition, the unmodified polyester resin (PE) preferably has a hydroxyl value not less than 5 mgKOH/g. In addition, the unmodified polyester resin (PE) preferably has an acid value of from 1 to 30 mgKOH/g, and more preferably from 5 to 20 mgKOH/g. When an unmodified polyester resin having such an acid value, affinity of the toner for receiving papers can be improved, resulting in improvement of low temperature fixability of the toner. However, when the acid value is too large, the charge stability of the toner deteriorates particularly when environmental conditions vary. In addition, when the acid value varies in the polymerization process of preparing the unmodified polyester resin, it is difficult to control the emulsification process (i.e., the toner granulation process varies), resulting in variation in particle diameter and particle forms of the resultant toner particles.

The acid value and hydroxyl value of a resin are measured by the following methods.

Acid Value

The acid value is determined by the method described in JIS K0070-1992.

At first, about 0.5 g of a sample (resin), which is precisely measured, is mixed with 120 ml of tetrahydrofuran (THF). The mixture is agitated for about 10 hours at room temperature (23° C.) to prepare a sample solution. The sample solution is subjected to titration using a N/10 alcohol solution of potassium hydroxide. The acid value (AV) of the sample is determined by the following equation.

$$AV=(KOH\times N\times 56.1)/W$$

wherein KOH represents the amount (ml) of KOH consumed in the titration, N represents the factor of N/10 potassium hydroxide, and W represents the precise weight of the sample.

The instrument and measurement conditions are as follows.

Instrument: Automatic potentiometric titrator DL-53(from Mettler Toledo K.K.)
Electrode: DG-113-SC (from Mettler Toledo K.K.)
Analysis software: LabX Light Version 1.00.000
Calibration: A mixture solvent of 120 ml of toluene and 30 ml of ethanol is used.
Measurement temperature: 23° C.
Conditions of the Instrument
Stir
Speed: 25%
Time: 15 sec
EQP titration
Titrant/Sensor
Titrant: $CH_3ONa$
Concentration: 0.1 mol/L
Sensor: DG115
Unit of measurement: mV
Predispensing to volume
Volume: 1.0 mL
Wait time: 0 sec
Titrant addition Dynamic
dE (set): 8.0 mV
dV (min): 0.03 mL
dV (max): 0.5 mL
Measure mode Equilibrium controlled
dE: 0.5 mV
dt: 1.0 sec
t(min): 2.0 sec
t(max): 20.0 sec
Recognition
Threshold: 100.0
Steepest jump only: No
Range: No
Tendency: None
Termination
At maximum volume: 10.0 ml
At potential: No
At slope: No
After number EQPS: Yes n=1
Comb. Termination conditions: No
Evaluation
Procedure: Standard
Potential 1: No
Potential 2: No
Stop for reevaluation: No Hydroxyl Value The instrument and the measurement conditions are the same as those in the above-mentioned acid value measurement method. The procedure is as follows.

At first, about 0.5 g of a sample, which is precisely measured, is mixed with 5 ml of an acetylizing agent. Then the mixture is heated in a temperature range of 100±0.5° C. using a bath. After one or two hours, the flask is drawn from the bath. After cooling the flask, water is added thereto and the mixture is shaken to decompose acetic anhydride. Further, in order to completely decompose acetic anhydride, the flask is heated for 10 minutes or more using the bath. After cooling the flask, the inner surface of the flask is well washed with an organic solvent. This liquid is subjected to a potentiometric titration treatment using a N/2 ethyl alcohol solution of potassium hydroxide to determine the hydroxyl value of the sample. The measurement method is based on JIS K0070-1966.

The modified polyester resins for use as the binder resin are typically prepared by the following method, but the preparation method is not limited thereto. At first, a polyol (PO) and a polycarboxylic acid (PC) are heated to a temperature ranging from 150 to 280° C. in the presence of an esterification catalyst such as tetrabutoxy titanate and dibutyl tin oxide to be reacted. In this case, generated water is removed under a reduced pressure, if necessary. Thus, a polyester resin having a hydroxyl group is prepared. The thus prepared polyester resin is reacted with a polyisocyanate (PIC) at a temperature ranging from 40 to 140° C. to prepare a polyester prepolymer (A) having an isocyanate group. The prepolymer (A) is reacted with an amine (B) at temperature ranging from 0 to 140° C. to prepare a urea-modified polyester resin (UMPE). The modified polyester resin preferably has a number average molecular weight of from 1,000 to 10,000 and more preferably from 1,500 to 6,000. When the materials PIC, A and B are reacted, one or more solvents maybe used if desired. Specific examples of the solvents include solvents inactive with PICs such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide); and ethers (e.g., tetrahydrofuran).

In order to impart a good combination of high temperature preservability, low temperature fixability and offset resistance to the toner, the polyester resin having an acidic group preferably includes tetrahydrofuran-soluble components having a weight average molecular weight of from 1,000 to 30,000. When the average molecular weight is too low, the high temperature preservability of the toner deteriorates. In contrast, when the average molecular weight is too high, the offset resistance deteriorates due to insufficient urea-modification caused by stearic hindrance of the prepolymer.

In the present application, the molecular weight and molecular weight distribution of a resin is determined by gel permeation chromatography (GPC). The method is as follows.

1) the column is allowed to settle in a chamber heated to 40° C. so as to be stabilized;
2) tetrahydrofuran (THF) is passed through the column thus heated to 40° C. at a flow rate of 1 ml/min; and
3) then 50 to 200 μl of a tetrahydrofuran(THF) solution of a resin having a solid content of from 0.05 to 0.6% by weight is injected to the column to obtain a molecular distribution curve of the resin.

The molecular weight distribution of the resin is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes are available from Pressure Chemical Co., or Tosoh Corp. It is preferable to prepare a working curve using ten or more kinds of monodisperse polystyrenes. In measurements, it is preferable to use a RI (refractive index) detector as the detector.

The unmodified polyester resin used as a binder resin preferably has an acid value of from 1.0 to 50.0 mgKOH/g. In this case, by adding a basic compound (such as tertiary amines) to an aqueous medium in an emulsifying or dispersing process, a good combination of low temperature fixability, hot offset resistance, high temperature preservability, and charge stability can be imparted to the toner. When the acid value is too high, the molecular weight growth reaction and/or crosslinking reaction of the binder resin precursor becomes insufficient, resulting in deterioration of hot offset resistance. When the acid value is too low, the dispersion stability effect is hardly produced by the basic compound added, and in addition the molecular weight growth reaction and/or crosslinking reaction tend to excessively proceed, and therefore it is difficult to control the molecular weight of the modified polyester resin.

The high temperature preservability of the modified polyester resin depends on the glass transition temperature of the unmodified polyester resin from which the modified polyester resin is derived. In the toner of the present invention, it is preferable that the unmodified polyester resin (i.e., the polyester resin before modification) has a glass transition temperature of from 35 to 65° C. When the glass transition temperature is too low, the high temperature preservability of the toner deteriorates. In contrast, when the glass transition temperature is too high, the low temperature fixability of the toner deteriorates.

The method for measuring the glass transition temperature of a resin is measured by an instrument TG-DSC system TAS-100 manufactured by RIGAKU CORPORATION. The procedure for measurements of glass transition temperature is as follows:

1) about 10 mg of a sample is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is heated again from room temperature to 150° C. in a nitrogen atmosphere at a temperature rising speed of 10° C./min to perform a DSC measurement.

The glass transition temperature of the sample is determined using an analysis system of the TAS-100 system. Namely, the glass transition temperature is defined as the contact point between the tangent line of the endothermic curve at the temperatures near the glass transition temperature and the base line of the DSC curve.

The prepolymer (A) for use in preparing the modified polyester resin preferably has a weight average molecular weight of from 3,000 to 20,000 to impart a good combination of low temperature fixability and hot offset resistance to the toner. When the weight average molecular weight is too low, it is difficult to control the reaction speed, and thereby the targeted modified polyester resin cannot be stably prepared. In contrast, when the weight average molecular weight is too high, the targeted modified polyester resin cannot be prepared, and thereby a toner having good offset resistance cannot be prepared.

The unmodified polyester resins for use as the binder resin are typically prepared by the method mentioned above for use in preparing the polyester resin having a hydroxyl group. The thus prepared polyester resin is dissolved in a reaction liquid including a UMPE after the urea denaturation reaction.

The toner of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used as release agents.

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Such master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The toner of the present invention optionally includes a charge controlling agent. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03(Nigrosine dye), BONTRON P-51 (quaternary ammonium salt), BONTRON S-34(metal-containing azo dye), BONTRON E-82(metal complex of oxynaphthoic acid), BONTRON E-84(metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038(quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147(boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density. When preparing toner particles by a pulverization method, the charge controlling agent and release agent can be mixed with a master batch and a binder resin to be melted and kneaded. When preparing toner particles by a granulation method (such as polymerization methods), the materials can be dissolved or dispersed in a solvent together with other toner constituents (such as colorants and binder resins) to prepare a toner composition liquid.

Alternatively, the charge controlling agent can be fixed to the surface of toner particles including at least a colorant and a binder resin by a method in which particles of the charge controlling agent and toner particles are mixed in a container using a rotor. In this case, it is preferable that the container has no projection on the inner surface thereof and the peripheral speed of the rotor is from 40 to 150 m/sec.

The above-mentioned charge controlling agent and release agent can be kneaded with a master batch and a binder resin. Alternatively, the charge controlling agent and the release agent can be added to an organic solvent when the toner composition liquid is prepared.

The toner of the present invention preferably has an acid value of from 0.5 to 40.0 mgKOH/g, which is caused by the carboxyl groups of the unmodified polyester resin used as a binder resin. In this case, the toner has a good combination of low temperature fixability and hot offset resistance.

The acid value of a toner can be measured by the method mentioned above for use in measuring the acid value of a binder resin. Specifically, the procedure for measuring the acid vale of a resin is repeated except that 0.5 g of a toner is used as a sample instead of 0.5 g of a resin. When the toner includes THF-insoluble components, the acid value of only the THF-soluble components is measured.

The toner of the present invention preferably has a glass transition temperature of from 40 to 70° C. In this case, the toner has a good combination of low temperature fixability, high temperature fixability and durability. When the glass transition temperature of the toner is too low, the toner causes a blocking problem in that the toner particles aggregate in a developing device and a filming problem in that a film of the toner is formed on the surface of a photoreceptor. In contrast, when the glass transition temperature of the toner is too high, the low temperature fixability of the toner deteriorates.

The toner of the present invention is preferably prepared by the following method. However, the preparation method is not limited thereto.

A toner composition liquid, which is prepared by dissolving or dispersing toner constituents (such as binder resins (including a reactive polyester), modified layered inorganic materials, colorants and additives) in a solvent, is dispersed in an aqueous medium to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In the aqueous medium, a reactive modified polyester resin (such as polyester prepolymers (A) having an isocyanate group) is reacted with an amine (B) to produce a urea-modified polyester resin (UMPE). In order to stably disperse a toner composition liquid including such a polyester prepolymer (A) and a urea-modified polyester resin (UMPE) in an aqueous medium, it is preferable to apply a shearing force to the mixture. The reactive modified polyester can be mixed with other toner constituents such as colorants, colorant master batches, release agents, charge controlling agents, unmodified polyester resins when the materials are dispersed in an aqueous medium to prepare a toner composition liquid. However, it is preferable that the reactive modified polyester and the other toner constituents are previously mixed, the mixture is dissolved or dispersed in a solvent to prepare a toner composition liquid, and then the toner composition liquid is dispersed in an aqueous medium. In addition, the toner constituents such as colorants, release agents and charge controlling agents are not necessarily mixed with other toner constituents when particles are formed in an aqueous medium, and can be mixed with the resultant toner particles formed in the aqueous medium. For example, a method in which after particles including no colorant are formed in an aqueous medium, the particles are dyed with a colorant using a known dyeing method can also be used.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc. In order to prepare a dispersion having a particle diameter of from 2 to 20 μm, high speed shearing dispersion machines are preferably used.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C. It is preferable that dispersing is performed at a relatively high temperature because the dispersion has a low viscosity and thereby dispersing can be easily performed.

The weight ratio of the aqueous medium to the toner composition liquid including a polyester resin (such as UMPE and prepolymer (A)) is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified and dispersed in an aqueous medium, a dispersant such as surfactants, particulate inorganic dispersants, particulate polymer dispersants is preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl) glycin, di (octylaminoethyle) glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfo nate, fluoroalkyl (C11-C20) carboxylic acids and their metal salts, perfluoroalkyl (C7-C13) carboxylic acids and their metal salts, perfluoroalkyl (C4-C12)sulfonate and their metal salts, perfluorooctanesulfonic acid diethanol amides, N-propyl-N-(2-hydroxyethyl) perfluorooctanesulfone amide, perfluoroalkyl (C6-C10) sulfoneamidepropyltrimethylammonium salts, salts of perfluoroalkyl (C6-C10)-N-ethylsulfonylglycin, monoperfluoroalkyl (C6-C16) ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl (C6-C10)sulfoneamidepropyltrimethylammonium salts, benzalkonium salts, benzetonium chloride, pyridinium salts, imidazolinium salts, etc. Specific examples of the marketed products thereof include SARFRONS-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Inorganic dispersants hardly soluble in water, such as tricalcium phosphate, calcium carbonate, titanium oxide, colloidal silica and hydroxyapatite can also be used.

Particulate polymers have the same effect as the particulate inorganic dispersants. Specific examples of the particulate polymers include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Fine Chemical Co., Ltd.)

Further, it is preferable to stabilize the emulsion or dispersion using a polymer protection colloid in combination with the inorganic dispersants and particulate polymers.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In order to reduce the viscosity of the toner composition liquid, solvents capable of dissolving polyesters such as urea-modified polyester resins and polyester prepolymers can be used. In this case, the resultant toner particles have a sharp particle diameter distribution. Suitable solvents include volatile solvents having a boiling point lower than 150° C., and preferably lower than 100° C., so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used. The weight ratio of the solvent to the polyester prepolymer is generally from 0/100 to 300/100, preferably from 0/100 to 100/100 and more preferably from 25/100 to 70/100. When a solvent is used, the solvent is removed from the reaction product under normal or reduced pressure after the molecular weight growth reaction and/or the crosslinking reaction of a modified polyester (i.e., a polyester prepolymer) with an amine.

The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and dioctyltin laurate can be used, if desired, for the reaction. As mentioned above, amines (B) are typically used as the molecular weight growing agent and/or the crosslinking agent.

When preparing toner particles of the toner of the present invention, it is preferable that the reaction product, which has been subjected to a molecular weight growth reaction and/or a crosslinking reaction, is agitated at a temperature lower than the glass transition temperature of the binder resin included in the particles without evaporating the solvent included in the particles to prepare aggregated particles. After the shape and size of the resultant particles are confirmed, the solvent is removed from the reaction product at a temperature of from 10 to 50° C. By performing agitation before the solvent removal operation, the particles are deformed. The conditions such as temperature, agitation speed and agitation time should be properly determined such that the resultant toner particles have the desired shape and size. For example, when the concentration of the organic solvent in the oil phase liquid in the reaction product is high and thereby the oil phase liquid has a low viscosity, the resultant aggregated particles tend to have a spherical form. In contrast, when the concentration of the organic solvent in the oil phase liquid in the reaction product is low, particles cannot be well aggregated because the oil phase liquid has a high viscosity. Therefore, proper conditions should be set when preparing toner particles. In other words, it is possible to adjust the shape of the toner particles by adjusting the conditions.

The ratio (Dv/Dn) of the volume average particle diameter (Dv) of the toner to the number average particle diameter (Dn) thereof can be controlled by controlling factors such as viscosities of the aqueous phase liquid and oil phase liquid, and properties and added amount of the particulate resin included in the aqueous phase. In addition, the volume average particle diameter and the number average particle diameter of the toner can be controlled by controlling factors such as properties and added amount of the particulate resin included in the aqueous phase.

The toner of the present invention can be used for a two-component developer by being mixed with a magnetic carrier. In this case, the content of the toner is preferably from 1 to 10 parts by weight per 100 parts by weight of a carrier.

Suitable carriers for use in the two component developer include known carrier materials such as iron powders, ferrite powders, magnetite powders, magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers (such as terpolymers of tetrafluoroethylene, vinylidenefluoride and other monomers including no fluorine atom), silicone resins, etc.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is larger than 1 μm, it is hard to control the resistance of the resultant carrier.

The toner of the present invention can also be used as a one-component magnetic developer or a one-component non-magnetic developer, which includes no carrier.

The image forming apparatus of the present invention will be explained by reference to FIGS. 1 and 2.

Figure 2:
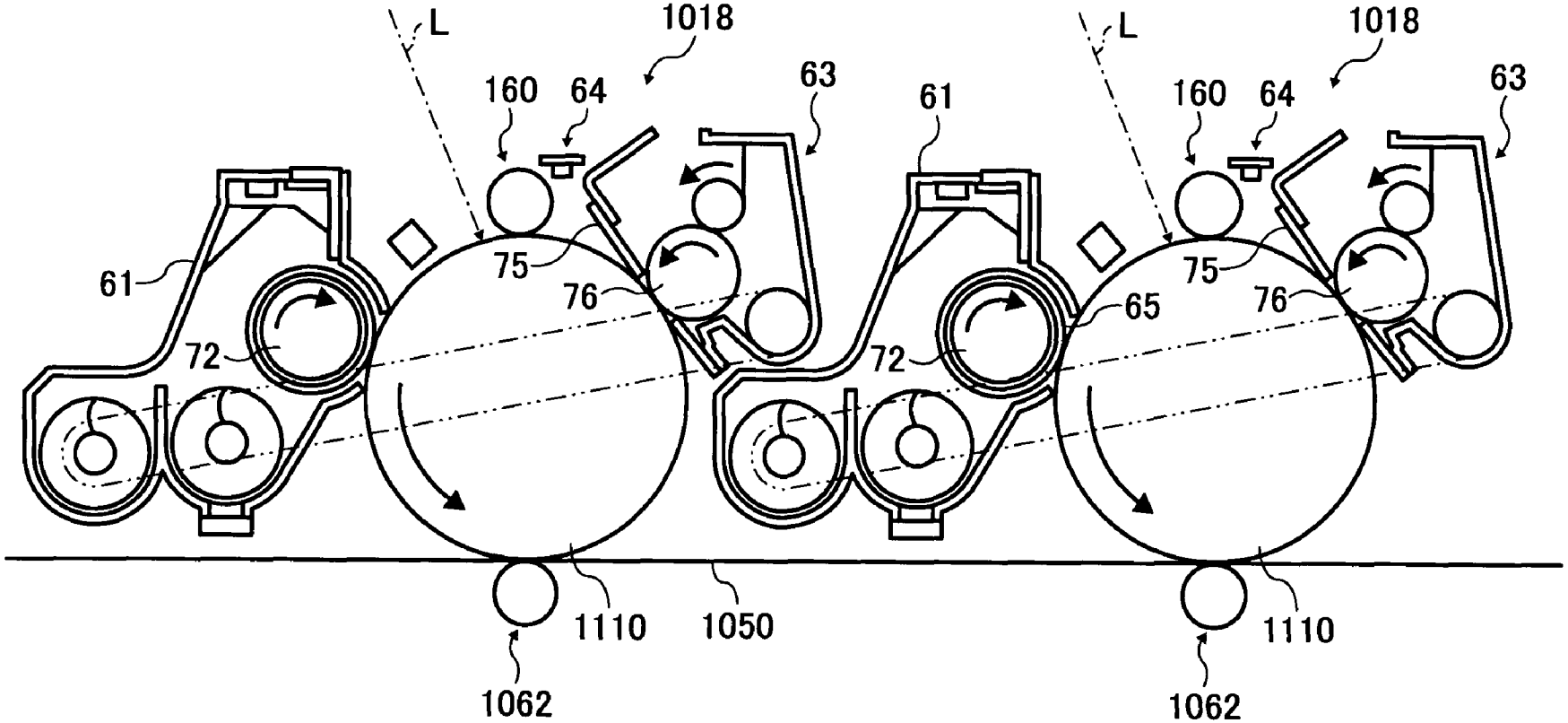
FIG. 2 is an enlarged view illustrating the image forming section of the image forming apparatus illustrated in FIG. 1.

FIG. 1 is a schematic view illustrating a tandem color image forming apparatus, and FIG. 2 illustrates the image forming section of the tandem color image forming apparatus. The tandem color image forming apparatus includes a main body 150, a receiving material storing and feeding section 200, a scanner 300 and an automatic document feeder (ADF) 400.

In the main body 150, an intermediate transfer medium 1050 having an endless belt form is provided at the center of the main body. The intermediate transfer medium is clockwise rotated while tightly stretched by support rollers 1014, 1015 and 1016. An intermediate transfer medium cleaner 1017 is arranged in the vicinity of the support roller 1015 to remove toner particles remaining on the surface of the intermediate transfer medium even after a secondary image transfer process. An image forming section 120 is arranged along the part of the intermediate transfer medium supported by the support roller 1014 and 1015. The image forming section 120 includes four image forming devices 1018 for forming yellow, magenta, cyan and black images. A light irradiating device 1021 is provided in the vicinity of the image forming section 120. A secondary image transfer device 1022 is provided on the side of the intermediate transfer medium opposite to the side facing the image forming devices. The secondary image transfer device 1022 includes a secondary transfer belt 1024 which is an endless belt and which is rotated while tightly stretched by two rollers 1023. A sheet of a receiving material, which has been fed from the receiving material storing and feeding section, is fed by the secondary transfer belt 1024 while contacted with the intermediate transfer medium 1050. A fixing device 1025 is provided in the vicinity of the secondary image transfer device 1022. The fixing device 1025 includes a fixing belt 1026 which is an endless belt, and a pressure roller 1027 pressed to the fixing belt.

The image forming apparatus includes a reversing device 1028, which is provided in the vicinity of the secondary image transfer device 1022 and the fixing device 1025 to reverse a sheet of the receiving material when a double-sided copy is produced.

Next, a full color image forming operation will be explained by reference to FIGS. 1 and 2.

When a color copy is produced by the image forming apparatus, at first an original is set on a table 130 of the ADF 400. Alternatively, an original is directly set on a glass plate 1032 of the scanner 300 after opening the ADF 400 and then the ADF is closed. When a start switch (not shown) is pressed, the original set on the table 130 is fed to the glass plate 1032 and then driving of the scanner 300 is started to read the image information of the original fed from the ADF or directly set on the glass plate 1032. Specifically, a first traveler 1033 starts to run and irradiates the surface of the original so that the light reflected from the original is fed toward a second traveler 1034, which also starts to run. The light reflected from a mirror of the second traveler 1034 is fed to the sensor 1036 through a focus lens 1035. Thus, the color image information of the original is read by the scanner 300. The color image information is converted to yellow, magenta, cyan and black image information.

The yellow, magenta, cyan and black image information is sent to the respective image forming devices 1018 of the image forming section 120, and the image forming devices form yellow, magenta, cyan and black images according to the information. The image forming devices 1018 include image bearing members 1010Y, 1010M, 1010C and 1010K for bearing thereon yellow, magenta, cyan and black images, respectively; chargers 160 configured to charge the surfaces of the respective image bearing members; developing devices 61 configured to develop electrostatic latent images, which are formed on the image bearing members by irradiating the charged image bearing members with image wise light L (illustrated in FIG. 2) to form yellow, magenta, cyan and black color toner images on the respective image bearing members 1010; transfer chargers 1062 configured to applying a transfer bias to the intermediate transfer medium to transfer the toner images on the image bearing members 1010 to the intermediate transfer medium 1050; cleaning devices 63 configured to clean the surface of the image bearing members using respective cleaning members 76 (such as cleaning brushes) and 75 (such as blades); and dischargers 64 configured to discharge charges remaining on the image bearing members even after the cleaning operation.

Electrostatic latent images formed on the image bearing members 1010 by the chargers 160 and the light irradiating device 1021 are developed with respective color developers, which includes respective color toners (which is the toner of the present invention) and which are borne on respective developing members 72. Thus, yellow, magenta, cyan and black toner images are formed on the respective image bearing members 1010Y, 1010M, 1010C and 1010K.

The yellow, magenta, cyan and black toner images thus prepared on the respective image bearing members 1010 are transferred onto the intermediate transfer medium 1050 one by one so as to be overlaid on the intermediate transfer medium (primary transfer process). Thus, a combined color image including yellow, magenta, cyan and black toner images is formed on the intermediate transfer medium 1050.

The receiving material storing and feeding section 200 includes plural cassettes 144 arranged one by one in a vertical direction in a receiving material bank 143. One of feeding rollers 142 is selectively rotated to feed an uppermost sheet of the receiving material sheets stored in the cassette. Each cassette includes a separating roller 145 configured to separate plural sheets of the receiving material and to feed the separated sheet to a feeding passage 146. The sheet is fed to a second feeding passage 148 by feeding rollers 147, and is stopped by registration rollers 1049 when reaches the registration rollers. Alternatively, sheets of the receiving material set on a manual tray 1054 may be fed to the registration rollers along a passage 1053 after being separated by separating rollers 1058.

In general, the registration rollers 1049 are grounded. However, a bias can be applied to the registration rollers to prevent adhesion of paper dust thereto.

The registration rollers 1049 timely rotate to feed the sheet to a secondary transfer nip formed by the intermediate transfer medium 1050 and the secondary image transfer device 1022 so that the combined color toner image on the intermediate transfer medium 1050 is transferred to a proper portion of the sheet. Thus, a color toner image is formed on the sheet. Toner particles remaining on the intermediate transfer medium 1050 even after the secondary transfer operation are removed therefrom by the intermediate transfer medium cleaner 1017.

The receiving material sheet bearing the thus prepared color toner image thereon is then fed to the fixing device 1025 by the secondary image transfer device 1022. The color toner image is fixed to the sheet by the fixing device 1025 upon application of heat and pressure thereto. Then the sheet bearing a fixed color toner image thereon is discharged by a discharging roller 1056 to be stacked on a tray 1057. Alternatively, the sheet may be reversed by a switching pick 1055 to be fed again to the secondary transfer nip so that another toner image is formed on the opposite side of the sheet. In this case, after the toner image is fixed to the sheet by the fixing device 1025, the sheet is discharged by the discharging roller 1056 to be stacked on the tray 1057.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation of Unmodified Polyester Resin)

The following components were contained in a reaction vessel equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 690 parts |
| Terephthalic acid | 256 parts |

Then the reaction was further continued for 5 hours under a reduced pressure of from 10 to 15 mmHg (1332 to 1998 Pa). After the reaction product was cooled to 160° C., 18 parts of phthalic anhydride was added thereto, and the mixture was reacted for 2 hours. Thus, an unmodified polyester resin (1) was prepared. It was confirmed that the unmodified polyester resin (1) has a weight average molecular weight of 4,000, an acid value of 10 mgKOH/g and a glass transition temperature of from 50° C.

(Preparation of Prepolymer)

The following components were contained in a reaction vessel equipped with a condenser, a stirrer, and a nitrogen feed pipe, and reacted for 8 hours at 230° C. under normal pressure.

| | |
|---|---|
| Ethylene oxide (2 mole) adduct of bisphenol A | 800 parts |
| Isophthalic acid | 180 parts |
| Terephthalic acid | 60 parts |
| Dibutyltin oxide | 2 parts |

Then the reaction was further continued for 5 hours under a reduced pressure of from 10 to 15 mmHg (1332 to 1998 Pa) while removing water generated by the reaction. After the reaction product was cooled to 160° C., 32 parts of phthalic anhydride was added thereto, and the mixture was reacted for 2 hours.

After the reaction product was cooled to 80° C., 170 parts of isophorone diisocyanate was reacted with the reaction product in ethyl acetate. Thus, a prepolymer (1) having an isocyanate group was prepared.

(Synthesis of Ketimine Compound)

In a reaction vessel equipped with a stirrer and a thermometer, 30 parts of isophorone diamine and 70 parts of methyl ethyl ketone were mixed and reacted for 5 hours at 50° C. to prepare a ketimine compound (1).

(Preparation of Toner)

The following components were mixed to prepare a resin solution.

| | |
|---|---|
| Prepolymer (1) prepared above | 14.3 parts |
| Polyester resin (1) prepared above | 55 parts |
| Ethyl acetate | 78.6 parts |

Then 4.3 parts of a paraffin wax serving as a release agent, 4 parts of a copper phthalocyanine blue pigment serving as a colorant, and 2 parts of an organic ion-modified montmorillonite were mixed and agitated for 5 minutes at 60° C. using a TK HOMOMIXER mixer, whose rotor was rotated at a revolution of 12,000 rpm. Further, the mixture was dispersed for 30 minutes at 20° C. using a bead mill. Thus, a toner composition liquid (1) was prepared.

Next, 265 parts of a 10% by weight suspension of tricalcium phosphate, 0.2 parts of sodium dodecylbenzene sulfonate and 306 parts of ion-exchange water were mixed to prepare an aqueous phase liquid. The above-prepared toner composition liquid (1) and 2.7 parts of the ketimine compound were added to the aqueous phase liquid while agitating the mixture (emulsion) using the TK HOMOMIXER mixer, whose rotor was rotated at a revolution of 12,000 rpm, to perform a urea reaction. In this regard, the particle diameter and particle diameter distribution of particles in the emulsion were checked with a microscope. In a case where the particle diameter is large, the agitation was further performed for 5 minutes at a revolution of 14,000 rpm. In a case where the particle diameter is small, the toner preparation operation was performed again while changing the revolution to 10,000 rpm.

The thus prepared emulsion was then agitated for 2 hours at 30° C. using the TK HOMOMIXER mixer, whose rotor was rotated at a revolution of 300 rpm. Then the solvent (i.e., ethyl acetate) was removed from the emulsion over 1 hour under a reduced pressure to prepare a dispersion. The dispersion was filtered to obtain particles, and then the particles were washed and dried. Thus, toner particles (1) having irregular forms were prepared.

One hundred (100) parts of the thus prepared toner particles (1) were mixed with 1.0 part of a hydrophobized silica and 0.5 parts of a hydrophobized titanium oxide, which are external additives. The mixture was well mixed using a HENSCHEL MIXER mixer (from Mitsui Mining Co., Ltd.). Thus, a toner (1) was prepared.

Example 2

The procedure for preparation of the toner in Example 1 was repeated except that the paraffin wax serving as the release agent was replaced with 7.0 parts of a carnauba wax.

Thus, a toner (2) was prepared.

Example 3

The procedure for preparation of the toner in Example 1 was repeated except that the added amount of the paraffin wax serving as the release agent was changed from 4.3 parts to 2.3 parts.

Thus, a toner (3) was prepared.

Example 4

The procedure for preparation of the toner in Example 2 was repeated except that the added amount of the carnauba wax serving as the release agent was changed from 7.0 parts to 9.0 parts.

Thus, a toner (4) was prepared.

Comparative Example 1

The procedure for preparation of the toner in Example 1 was repeated except that the revolution of the rotor of the HOMOMIXER mixer was changed from 12,000 rpm to 9,000 rpm.

Thus, a toner (5) was prepared.

Comparative Example 2

The procedure for preparation of the toner in Example 1 was repeated except that the added amount of the paraffin wax serving as the release agent was changed from 4.3 parts to 0.5 parts.

Thus, a toner (6) was prepared.

Comparative Example 3

The procedure for preparation of the toner in Example 1 was repeated except that the added amount of the paraffin wax serving as the release agent was changed from 4.3 parts to 10.5 parts.

Thus, a toner (7) was prepared.

Comparative Example 4

(Preparation of Intermediate Polymer)

The following components were contained in a reaction vessel equipped with a condenser, a stirrer, and a nitrogen feed pipe, and reacted for 10 hours at 230° C. under normal pressure.

| | |
|---|---|
| Ethylene oxide (2 mole) adduct of bisphenol A | 685 parts |
| Propylene oxide (2 mole) adduct of bisphenol A | 81 parts |
| Terephthalic acid | 281 parts |
| Trimellitic anhydride | 24 parts |
| Dibutyltin oxide | 3 parts |

Then the reaction was further continued for 8 hours under a reduced pressure of from 10 to 15 mmHg (1332 to 1998 Pa).

Thus, an intermediate polyester was prepared.

(Preparation of Prepolymer)

Next, the following components were contained in a reaction vessel equipped with a condenser, a stirrer, and a nitrogen feed pipe, and reacted for 8 hours at 100° C.

| | |
|---|---|
| Intermediate polyester | 414 parts |
| Ethyl acetate | 1200 parts |

In addition, isophorone diisocyanate was added thereto.

Thus, a prepolymer (2) was prepared.

(Preparation of Unmodified Polyester)

The following components were contained in a reaction vessel equipped with a condenser, a stirrer and a nitrogen feed pipe to perform a polycondensation reaction for 10 hours at 210° C. under normal pressure and nitrogen gas flow.

| | |
|---|---|
| Ethylene oxide (2 mole) adduct of bisphenol A | 690 parts |
| Terephthalic acid | 335 parts |

Then the reaction was further continued for 5 hours under a reduced pressure of from 10 to 15 mmHg (1332 to 1998 Pa) while removing water generated by the reaction, followed by cooling. Thus, an unmodified polyester resin (2) was prepared. It was confirmed that the unmodified polyester resin (2) has a weight average molecular weight of 6,000, an acid value of 20 mgKOH/g and a glass transition temperature of from 55° C.

(Preparation of Toner)

The following components were mixed to prepare a resin solution.

| | |
|---|---|
| Prepolymer (2) prepared above | 15.3 parts |
| Polyester resin (2) prepared above | 63.6 parts |
| Toluene | 40 parts |
| Ethyl acetate | 40 parts |

Then 5 parts of a carnauba wax serving as a release agent, 4 parts of a copper phthalocyanine blue pigment serving as a colorant, and 3.5 parts of an organic ion-modified montmorillonite were mixed and agitated for 5 minutes at 60° C. using a TK HOMOMIXER mixer, whose rotor was rotated at a revolution of 12,000 rpm. Further, the mixture was dispersed for 30 minutes at 25° C. using a bead mill. In addition, 1.1 parts of diphenylmethane diisocyanate serving as a molecular weight growing agent was added thereto to be dissolved. Thus, a toner composition liquid (3) was prepared.

Next, 294 parts of a 10% by weight suspension of tricalcium phosphate, 0.2 parts of sodium dodecylbenzene sulfonate and 406 parts of ion-exchange water were mixed to prepare an aqueous phase liquid. The above-prepared toner composition liquid (3) was added to the aqueous phase liquid while agitating the mixture (emulsion) for 10 minutes using the TK HOMOMIXER mixer whose rotor was rotated at a revolution of 12,000 rpm.

The thus prepared emulsion was then agitated for 30 minutes at 35° C. using the TK HOMOMIXER mixer whose rotor was rotated at a revolution of 300 rpm so that the particles aggregate. Then the solvent (i.e., ethyl acetate and toluene) was removed from the emulsion. The dispersion was filtered to obtain particles, and then the particles were washed and dried. Thus, toner particles were prepared.

One hundred (100) parts of the thus prepared toner particles were mixed with 1.0 part of a hydrophobized silica and 0.5 parts of a hydrophobized titanium oxide, which are external additives. The mixture was well mixed using a HENSCHEL MIXER mixer (from Mitsui Mining Co., Ltd.). Thus, a toner (8) was prepared.

Comparative Example 5

The procedure for preparation of the toner in Comparative Example 4 was repeated except that the added amount of the carnauba wax serving as the release agent was changed from 5 parts to 7.3 parts.

Thus, a toner (9) was prepared.

The thus prepared toners were evaluated as follows.

1. Glass Transition Temperature (Tg)

The glass transition temperature of a resin was measured with an instrument TG-DSC system TAS-100 manufactured by RIGAKU CORPORATION. The procedure for measurements of glass transition temperature is as follows:

1) About 10 mg of a sample is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is heated again from room temperature to 150° C. in a nitrogen atmosphere at a temperature rising speed of 10° C./min to perform a DSC measurement.

The glass transition temperature of the sample is determined using an analysis system of the TAS-100 system. Namely, the glass transition temperature is defined as the contact point between the tangent line of the endothermic curve at the temperatures near the glass transition temperature and the base line of the DSC curve.

2. Image Density (ID)

Each of developers including the respective toners was set in a digital full color copier IMAGIO COLOR 2800 from Ricoh Co., Ltd., and 150,000 monochrome copies of an original image with image area proportion of 50% were produced on sheets of a receiving paper TYPE 6000 from Ricoh Co., Ltd. After the running test, the image density of the last image was measured with a densitometer X-Rite (from X-Rite Inc.). The image density is defined as an average of the image densities of images produced by the color toner.

The image density is graded as follows.

◎: The image density is not lower than 1.8 and lower than 2.2.

○: The image density is not lower than 1.4 and lower than 1.8.

Δ: The image density is not lower than 1.2 and lower than 1.4.

X: The image density is lower than 1.2.

3. Granularity and Definition of Image

Each developer was set in a digital full color copier IMAGIO COLOR 2800 from Ricoh Co., Ltd., and monochrome copies of an original image were produced. The produced images were visually observed to grade the images with respect to granularity and definition.

The image quality is graded as follows.

◎: The image quality thereof is almost the same as that of images produced by offset printing.

○: The image quality thereof is slightly worse than that of images produced by offset printing.

Δ: The image quality thereof is worse than that of images produced by offset printing.

X: The image quality thereof is almost the same as that of images produced by conventional electrophotographic image forming apparatuses.

4. Background Development

Each developer was set in a digital full color copier IMAGIO COLOR 2800 from Ricoh Co., Ltd., and 30,000 monochrome copies of an original image with image area proportion of 50% were produced. After the running test, a white image was produced. When a latent image of the white image was developed, the image forming apparatus was turned off. The toner particles on the photoreceptor (i.e., toner particles in a white image area) were transferred to an adhesive tape. The blank adhesive tape and the adhesive tape bearing the toner particles were adhered on a white paper to determine the difference in optical density between the blank adhesive tape and the adhesive tape bearing the toner particles thereon. The optical density was measured by a spectrodensitometer 983 manufactured by X-Rite Inc. Background development is graded as follows.

◎: Difference in density is little.

○: Difference in density is small.

Δ: Difference in density is slightly large.

X: Difference in density is large.

5. Toner Scattering

Each developer was set in a digital full color copier IMAGIO COLOR 2800 from Ricoh Co., Ltd., and 50,000 monochrome copies of an original image were produced. Then the inside of the image forming apparatus was visually observed to determine whether the toner is scattered around the developing device.

Toner scattering is graded as follows.

○: The toner is hardly scattered.

Δ: The toner is slightly scattered but it is not a problem from a practical viewpoint.

X: The toner is seriously scatted and it is a problem from a practical viewpoint.

6. Fixability (Low Temperature Fixability (LTF) and Hot Offset Resistance (HOR))

Each developer was set in an image forming apparatus, IMAGIO MF2200 manufactured by Ricoh Co., Ltd., which is modified such that a TEFLON roller is used as the fixing roller. Copies of an image were produced using a paper TYPE 6200 from Ricoh Co., Ltd., while the fixing temperature was changed to evaluate the low temperature fixability (LTF) (i.e., the cold offset temperature) and the hot offset resistance (HOR) (i.e., the hot offset temperature) of the toner.

Specifically, the cold offset temperature is determined as follows.

1) The toner images fixed at different fixing temperatures are carefully observed to determine whether a cold offset phenomenon occurs.

In this regard, the fixing conditions are as follows.

Fixing speed: 120 to 150 mm/sec

Fixing pressure: $1.18\times10^5$ Pa (1.2 Kgf/cm$^2$) in surface pressure

Fixing nip width: 3 mm.

The cold offset temperature is defined as a fixing temperature below which a cold offset phenomenon is observed in the fixed images.

The low temperature fixability is graded as follows.

◎: The cold offset temperature is lower than 140° C.

○: The cold offset temperature is not lower than 140° C. and lower than 150° C.

□: The cold offset temperature is not lower than 150° C. and lower than 160° C.

Δ: The cold offset temperature is not lower than 160° C. and lower than 170° C.

X: The cold offset temperature is not lower than 170° C.

Conventional low temperature fixable toners typically have a cold offset temperature of from about 140 to about 150° C.

The hot offset temperature is determined as follows.

1) The images fixed at different fixing temperatures are carefully observed to determine whether a hot offset phenomenon occurs.

The hot offset temperature is defined as a fixing temperature above which a hot offset phenomenon is observed in the fixed images.

In this regard, the fixing conditions were as follows.

Fixing speed: 50 mm/sec

Fixing pressure: $1.96\times10^5$ Pa (2.0 Kgf/cm$^2$) in surface pressure

Fixing nip width: 4.5 mm.

The hot offset resistance is graded as follows.

◎: The hot offset temperature is not lower than 201° C.

○: The hot offset temperature is from 191° C. to 200° C.

□: The hot offset temperature is from 181° C. to 190° C.

Δ: The hot offset temperature is from 171° C. to 180° C.

X: The hot offset temperature is not higher than 170° C.

7. High Temperature Preservability

After each toner is allowed to settle at 50° C. for 8 hours, the toner is sieved for 2 minutes with a screen with openings of 42 mesh to determine the following residual ratio (R):

$$R(\%)=(Wr/Wt)\times100$$

wherein Wr represents the weight of the toner particles on the screen, and Wt represents the total weight of the sieved toner.

The high temperature preservability is graded as follows.

◎: The residual ratio is less than 10%.

○: The residual ratio is not less than 10% and less than 20%.

Δ: The residual ratio is not less than 20% and less than 30%.

X: The residual ratio is not less than 30%.

In this regard, the lower residual ratio a toner has, the better high temperature preservability the toner has.

The properties and image qualities of the toners are shown in Tables 1-1, 1-2 and 2.

TABLE 1-1

| | No. of toner | Dv (μm) | Dv/Dn | Average Circularity | Content of wax (A) (wt %) | (Dv/Dn − 1) × ¾ |
|---|---|---|---|---|---|---|
| Ex. 1 | 1 | 5.1 | 1.13 | 0.96 | 4.1 | 0.098 |
| Ex. 2 | 2 | 4.4 | 1.15 | 0.95 | 6.5 | 0.113 |
| Ex. 3 | 3 | 6.5 | 1.18 | 0.97 | 2.3 | 0.135 |
| Ex. 4 | 4 | 5.7 | 1.26 | 0.97 | 8.9 | 0.195 |
| Comp. Ex. 1 | 5 | 7.6 | 1.24 | 0.97 | 4.3 | 0.180 |
| Comp. Ex. 2 | 6 | 5.7 | 1.12 | 0.98 | 0.5 | 0.090 |
| Comp. Ex. 3 | 7 | 5.3 | 1.21 | 0.93 | 10.4 | 0.158 |

TABLE 1-1-continued

| | No. of toner | Dv (μm) | Dv/Dn | Average Circularity | Content of wax (A) (wt %) | (Dv/Dn − 1) × ¾ |
|---|---|---|---|---|---|---|
| Comp. Ex. 4 | 8 | 4.5 | 1.18 | 0.94 | 5.1 | 0.135 |
| Comp. Ex. 5 | 9 | 4.7 | 1.19 | 0.96 | 7.3 | 0.143 |

TABLE 1-2

| | Average particle diameter (Dv) of classified toner* (μm) | | | | |
|---|---|---|---|---|---|
| | Fine particles (FP) | Medium particles (MP) | (Dv'/Dn') | (Dv'/Dn' − 1) | Coarse particles (CP) |
| Ex. 1 | 3.5 | 6.2 | 1.09 | 0.09 | 7.0 |
| Ex. 2 | 3.1 | 4.1 | 1.11 | 0.11 | 8.2 |
| Ex. 3 | 4.3 | 7.3 | 1.13 | 0.13 | 9.1 |
| Ex. 4 | 3.0 | 4.2 | 1.18 | 0.18 | 9.8 |
| Comp. Ex. 1 | 3.5 | 6.5 | 1.17 | 0.17 | 10.2 |
| Comp. Ex. 2 | 3.4 | 6.2 | 1.09 | 0.09 | 7.4 |
| Comp. Ex. 3 | 4.1 | 7.5 | 1.15 | 0.15 | 9.5 |
| Comp. Ex. 4 | 3.2 | 4.6 | 1.13 | 0.13 | 9.3 |
| Comp. Ex. 5 | 4.0 | 5.0 | 1.14 | 0.14 | 8.3 |

Classified toner*: Each toner is classified into fine particles (FP), medium particles (MP) and coarse particles (CP) such that Dv' and Dn' of the medium particles satisfies the relationship (Dv'/Dn' − 1)/(Dv/Dn − 1) ≦ ¾.

TABLE 1-3

| | Content of wax in the toner (A) (wt %) | Content of wax in classified toner (wt %) | | | Wax content ratio | | |
|---|---|---|---|---|---|---|---|
| | | In FP (C) | In MP (B) | In CP (D) | FP (C/A) | MP (B/A) | CP (D/A) |
| Ex. 1 | 4.1 | 4.0 | 4.1 | 4.0 | 0.98 | 1.00 | 0.98 |
| Ex. 2 | 6.5 | 6.0 | 6.5 | 6.6 | 0.92 | 1.00 | 1.02 |
| Ex. 3 | 2.3 | 1.7 | 2.0 | 2.8 | 0.74 | 0.87 | 1.22 |
| Ex. 4 | 8.9 | 7.7 | 8.0 | 9.6 | 0.87 | 0.90 | 1.08 |
| Comp. Ex. 1 | 4.3 | 3.1 | 3.5 | 5.4 | 0.72 | 0.81 | 1.26 |
| Comp. Ex. 2 | 0.5 | 0.5 | 0.5 | 0.5 | 1.00 | 1.00 | 1.00 |
| Comp. Ex. 3 | 10.4 | 6.3 | 9.9 | 13.0 | 0.61 | 0.95 | 1.25 |
| Comp. Ex. 4 | 5.1 | 2.8 | 5.2 | 10.5 | 0.55 | 1.02 | 2.06 |
| Comp. Ex. 5 | 7.3 | 5.9 | 7.2 | 9.8 | 0.81 | 0.99 | 1.34 |

TABLE 2

| | ID | Granularity | Background development | Toner scattering | LTF | HOR |
|---|---|---|---|---|---|---|
| Ex. 1 | ◎ | ◎ | ◎ | ○ | ◎ | ◎ |
| Ex. 2 | ◎ | ◎ | ◎ | ○ | ◎ | ◎ |
| Ex. 3 | ◎ | ◎ | ○ | ○ | ○ | ○ |
| Ex. 4 | ○ | ○ | ○ | ○ | ○ | ◎ |
| Comp. Ex. 1 | X | X | Δ | Δ | X | ○ |
| Comp. Ex. 2 | ○ | ○ | Δ | Δ | ○ | X |

TABLE 2-continued

| | ID | Granularity | Background development | Toner scattering | LTF | HOR |
|---|---|---|---|---|---|---|
| Comp. Ex. 3 | X | X | X | X | X | ○ |
| Comp. Ex. 4 | X | X | X | X | X | X |
| Comp. Ex. 5 | X | X | X | X | X | X |

It is clear from Table 2 that the toners of the present invention have good combination of low temperature fixability and hot offset resistance and can produced high density images with low granularity without causing the background development problem and the toner scattering problem.

This document claims priority and contains subject matter related to Japanese Patent Application No. 2006-250343, filed on Sep. 15, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a colorant;

a release agent; and a modified layered inorganic material in which at least part of interlayer ions is modified with an organic ion, wherein the toner has a volume average particle diameter (Dv) of from 3 to 7 μm and a ratio (Dv/Dn) of the volume average particle diameter (Dv) to a number average particle diameter (Dn) of the toner of from 1.00 to 1.30, and satisfies the following relationships:

$$1\% \leqq A \leqq 10\%, \text{ and}$$

$$0.7 \leqq B/A \leqq 1.3,$$

wherein A represents an amount of the release agent included in the toner in units of percent by weight based on the total weight of the toner, and B represents an amount of the release agent included in particles of the toner in units of percent by weight based on the weight of toner particles comprising the release agent, wherein the particles of the toner are obtained by classifying the toner to an extent such that the following relationship is satisfied:

$$(Dv'/Dn'-1)/(Dv/Dn-1) \leqq 3/4,$$

wherein Dv' and Dn' respectively represent a volume average particle diameter and a number average particle diameter of the particles of the toner obtained by classification.

2. The toner according to claim 1, wherein the toner is prepared by a method comprising:

dissolving or dispersing a toner composition including at least one of a first binder resin and a resin precursor of a second binder resin, the colorant, the release agent, and the modified layered inorganic material in an organic solvent to prepare an oil phase liquid;

dispersing the oil phase liquid in an aqueous medium to prepare an emulsion; and removing the organic solvent from the emulsion to prepare toner particles.

3. The toner according to claim 2, wherein the oil phase liquid includes at least a resin precursor having a weight average molecular weight of from 3,000 to 20,000.

4. The toner according to claim 2, wherein the modified layered inorganic material is a clay modified by an organic ion, and wherein the clay modified by an organic ion is included in the oil phase liquid in an amount of from 0.05 to 5.0% by weight based on solid components included in the oil phase liquid.

5. The toner according to claim 1, wherein the toner is prepared by a method comprising:

dissolving or dispersing a toner composition including at least one of a first binder resin and a resin precursor of a second binder resin, a compound capable of making a reaction selected from the group consisting of molecular weight growth reactions, crosslinking reactions and combinations thereof with the resin precursor, the colorant, the release agent, and the modified layered inorganic material in an organic solvent to prepare an oil phase liquid;

dispersing the oil phase liquid in an aqueous medium including a particulate dispersant to prepare an emulsion;

subjecting the resin precursor to a reaction selected from the group consisting of molecular weight growth reactions, crosslinking reactions and combinations thereof in the emulsion; and removing the organic solvent from the emulsion to prepare toner particles.

6. The toner according to claim 1, wherein the toner has an average circularity of from 0.93 to 0.97.

7. The toner according to claim 1, wherein the toner includes particles having a circularity of not greater than 0.950 in an amount of from 20 to 80% by number.

8. The toner according to claim 1, wherein the toner includes particles having a particle diameter of not greater than 2 μm in an amount of not greater than 20% by number.

9. The toner according to claim 1, wherein the binder resin includes at least one polyester resin.

10. The toner according to claim 9, wherein the binder resin includes at least one polyester resin in an amount of from 50 to 100% by weight based on total weight of the binder resin.

11. The toner according to claim 9, wherein the at least one polyester resin includes tetrahydrofuran-soluble components having a weight average molecular weight of from 1,000 to 30,000.

12. The toner according to claim 9, wherein the at least one polyester resin includes an unmodified polyester resin having an acid value of from 1.0 to 50.0 mgKOH/g.

13. The toner according to claim 9, wherein the at least one polyester resin includes an unmodified polyester resin having a glass transition temperature of from 35 to 65° C.

14. The toner according to claim 1, wherein the toner has an acid value of from 0.5 to 40.0 mgKOH/g.

15. The toner according to claim 1, wherein the toner has a glass transition temperature of from 40 to 70° C.

16. The toner according to claim 1, wherein the toner further satisfies the following relationship:

$$0.7 \leqq C/A \leqq 1.3,$$

wherein C represents an amount of the release agent included in particles which are removed when classifying the toner as having relatively fine particle diameters.

17. The toner according to claim 1, wherein the toner further satisfies the following relationship:

$$0.7 \leqq D/A \leqq 1.3,$$

wherein D represents an amount of the release agent included in particles which are removed when classifying the toner as having relatively large particle diameters.

18. A method for preparing the toner according to claim 1, comprising:

dissolving or dispersing a toner composition including a first binder resin, the colorant, the release agent, and the modified layered inorganic material, in which at least part of interlayer ions is modified with an organic ion, in an organic solvent to prepare an oil phase liquid;

dispersing the oil phase liquid in an aqueous medium to prepare an emulsion; and removing the organic solvent from the emulsion to prepare toner particles.

19. The method according to claim 18, wherein the toner composition further includes a resin precursor of a second binder resin, and wherein the method further comprises:

subjecting the resin precursor to a reaction selected from the group consisting of molecular weight growth reactions, crosslinking reactions and combinations thereof in the emulsion.

20. An image forming method comprising:

developing an electrostatic latent image on an image bearing member with a developer including the toner according to claim 1 to prepare a toner image on the image bearing member;

transferring the toner image onto a receiving material optionally via an intermediate transfer medium; and cleaning a surface of the image bearing member with a blade to remove particles of the toner remaining thereon.

21. An image forming apparatus comprising:

an image bearing member configured to bear an electrostatic latent image thereon; and a developing device configured to develop the electrostatic latent image with a developer including the toner according to claim 1 to form a toner image on the image bearing member;

a transfer device configured to transfer the toner image onto a receiving material optionally via an intermediate transfer medium; and a cleaning device configured to clean a surface of the image bearing member with a blade to remove particles of the toner remaining thereon.

22. The toner according to claim 1, wherein the amount of the release agent (A) included in the toner in units of percent by weight is from 2.3 to 8.9 wt %.

23. The toner according to claim 22, wherein Dv/Dn is from 1.13 to 1.26.

24. The toner according to claim 23, wherein Dv'/Dn' is from 1.09 to 1.18.

25. The toner according to claim 24, which further satisfies the following relationship:

$$0.87 \leqq B/A \leqq 1.00.$$

26. The toner according to claim 25, which further satisfies the following relationship:

$$0.874 \leqq C/A \leqq 0.98,$$

wherein C represents the amount of the release agent included in particles which are removed when classifying the toner as having relatively fine particle diameters.

27. The toner according to claim 26, which further satisfies the following relationship:

$$0.98 \leqq D/A \leqq 1.22,$$

wherein D represents an amount of the release agent included in particles which are removed when classifying the toner as having relatively large particle diameters.

28. The toner according to claim 1, wherein the modified layered inorganic material is an intercalation material having layers between which the organic ions are incorporated.

* * * * *